US005199766A

United States Patent [19]

Montgomery

[11] Patent Number: 5,199,766

[45] Date of Patent: Apr. 6, 1993

[54] CAVITY INDUCED STIMULATION OF COAL DEGASIFICATION WELLS USING SOLVENTS

[75] Inventor: Carl T. Montgomery, Plano, Tex.

[73] Assignee: Atlantic Richfield Company, Los Angeles, Calif.

[21] Appl. No.: 805,162

[22] Filed: Dec. 11, 1991

[51] Int. Cl.[5] ..... E21B 43/26

[52] U.S. Cl. ..... 299/5; 166/308; 241/1; 299/16

[58] Field of Search ..... 166/307, 308; 299/4, 299/5, 16

[56] References Cited

U.S. PATENT DOCUMENTS 3,815,826 6/1974 Aldrich et al. ..... 241/1
3,850,477 11/1974 Aldrich et al. ..... 299/5
3,918,761 11/1975 Aldrich ..... 299/5
4,253,703 3/1981 Fonseca et al. ..... 299/5
4,283,089 8/1981 Mazza et al. ..... 166/308 X
4,400,034 8/1983 Chew ..... 166/307 X
5,014,788 5/1991 Puri et al. ..... 166/308

*Primary Examiner*—David J. Bagnell
*Attorney, Agent, or Firm*—Albert C. Metrailer

[57] ABSTRACT

An improved method for stimulating coal degasification wells comprising the use of a coal comminuting solvent to weaken the cleat structure of a coal seam immediately prior to use of high pressure gas in a gas cavitation process. A solvent such as ammonia is injected into the coal seam and allowed to dissolve materials from the cleat structure for a period of time sufficient to weaken that structure. Thereafter, high pressure gas is injected into the coal seam and suddenly released to cause disintegration of coal surrounding the borehole.

3 Claims, 1 Drawing Sheet

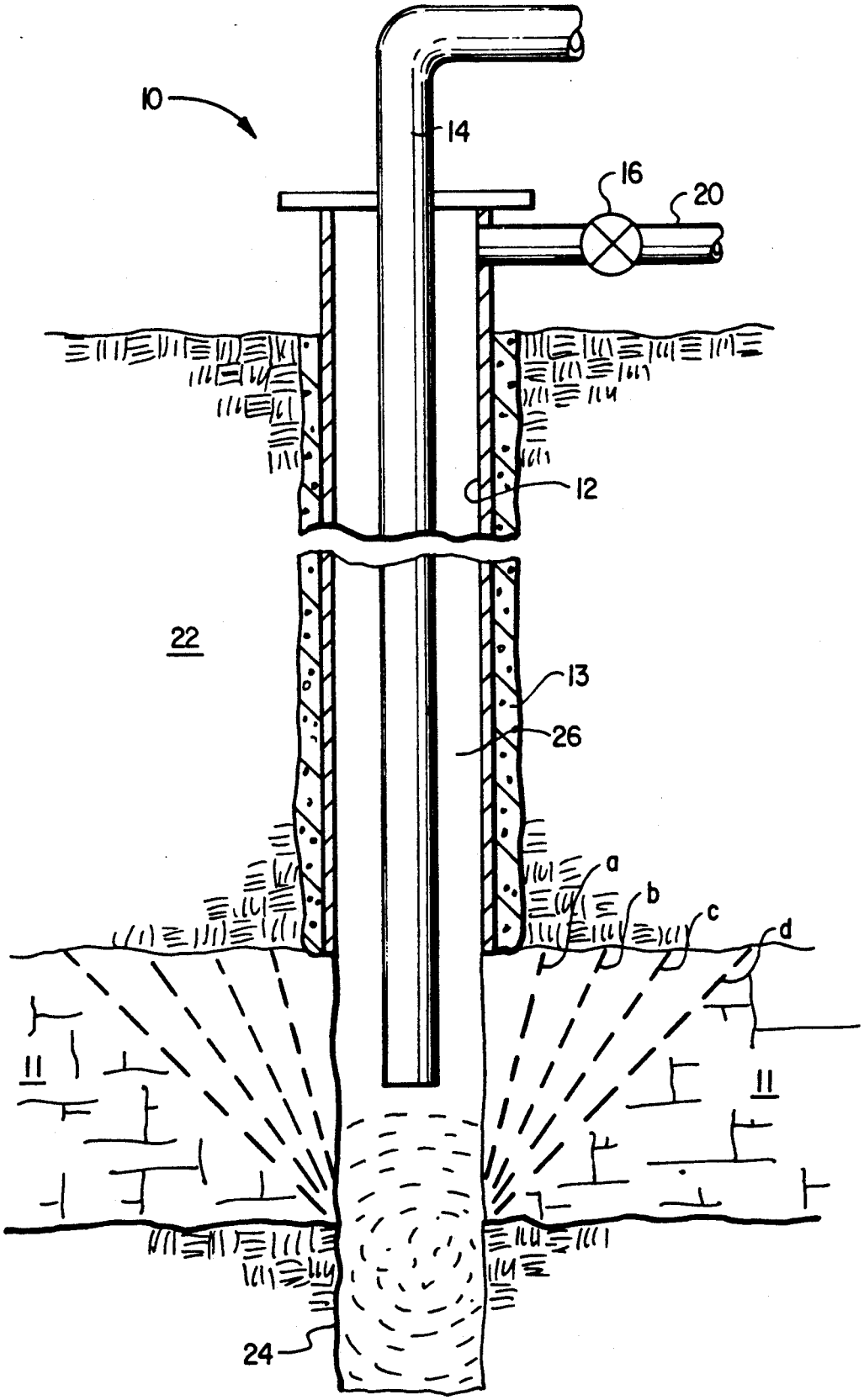
10
14
16
20
12
22
13
26
a
b
c
d
11
11
24

CAVITY INDUCED STIMULATION OF COAL DEGASIFICATION WELLS USING SOLVENTS

BACKGROUND OF THE INVENTION

The present invention relates to the production of gas from a coal seam and more particularly to an improved cavitation process wherein a coal comminuting solvent is injected into a coal seam followed by injection of high pressure gas which is then released to form a cavity in a coal seam.

Many subterranean coal seams have large volumes of hydrocarbon gases, usually including methane, trapped therein. These gases represent a valuable resource if they can be produced economically. Where a coal seam is to be mined later, it is beneficial from a safety standpoint to produce as much of these gases as possible before commencement of mining operations.

Presently, methane and any other gases are produced from the coal reservoirs through wells which are drilled into the coal seam. Once a well is drilled and completed, it is common to treat the coal seam in order to stimulate the production of methane therefrom. Generally, this involves some method of improving permeability of the coal seam. One such commonly used stimulation treatment involves hydraulically fracturing the coal seam generally in the same manner as used with conventional oil and gas bearing formations, see for example, U.S. Pat. No. 4,995,463.

Another technique which has been proposed for stimulating a coal seam is sometimes generally referred to as "cavity induced stimulation". In this technique, a wellbore is drilled through a coal seam and by use of various techniques a cavity is formed within the seam adjacent the wellbore. As the cavity is formed, the vertical stress component which normally acts on the coal above the cavity is partially transferred to the sides of the cavity which, in turn, causes the coal to become loaded inwardly as the cavity is being formed. This increased load would normally be greater than the natural load bearing capability of the coal and the coal will fail and break up into small fragments. As the coal fragments are removed from the cavity through the wellbore, a large cavity is formed thereby providing a relaxed zone into which existing fractures can open making the coal and surrounding rock more permeable to gas flow. This technique can be repeated until the bearing capacity of the coal equals or exceeds the redistributed stress. The net effect of forming a cavity into which surrounding coal can collect is the production of a highly permeable zone filled with fine grain coal particles. For a more complete description of the mechanics involved in a typical cavity induced stimulation process, see "Cavity Stress Relief Method to Stimulate Demethanation Boreholes" A.K. Alain and G.M. Denes, SPE/DOE/GRI 12843, presented at the 1984 SPE/DOE/GRI Unconventional Gas Recovery Symposium, Pittsburgh, Pa., May 13-15, 1984. The cavity used in the above-described technique can be formed in different ways. For example, in the above-cited paper, the cavity in the coal seam is disclosed as being formed by jetting water from the lower end of a dual drill-type string while using compressed air to remove the resulting coal fragments.

Another known technique which has been used to form a cavity in a cavity induced stimulation method involves the use of compressed air, nitrogen or other available gases. A wellbore is drilled and completed into a coal seam. A tubing string is then lowered into the wellbore and the well annulus is closed. Compressed gas is supplied through the tubing string to build up a high pressure in the coal seam adjacent the wellbore. The wellbore is then opened to suddenly vent the pressure, thereby allowing the gas within the cleats or fractures of the coal seam to expand and produce a back pressure which overcomes the induced hoop stress within the coal. Under proper conditions, the result of the sudden release of gas is that the coal fails and breaks into fragments which are then removed from the tubing string. This process can be repeated until the desired permeable zone is formed within the seam.

While this gas cavitation process has increased the initial methane production in some wells by as much as 4 to 5 fold, when compared to wells which were hydraulically fractured, it has also been shown that this stimulation technique has not worked in other wells. Studies indicated that this failure may be due to the cleat density being much less than it was in the successfully completed wells. However, it is believed it is more likely that the failures were due to the large hoop stresses induced in the coal during the drilling process. The lower cleat density increases the strength of the coal sufficiently that these hoop stresses cannot be overcome with the normal gas cavitation completion techniques.

SUMMARY OF THE INVENTION

The present invention provides a cavity induced stimulation method for improving the initial production of fluids such as methane from a subterranean coal formation or seam. In carrying out the method, a well is drilled to a point adjacent a coal seam and is cased to that point. The wellbore is then extended beyond the cased wellbore and into the seam. A coal comminuting solvent is then pumped down the wellbore and into the coal seam to a depth corresponding to the desired cavity size. The solvent may be displaced into the seam by use of compressed gas. Once injected, the wellbore is shut in to allow the solvent to dissolve or otherwise react with materials within the cleat or fracture structure of the coal seam. After an appropriate shut-in time, a gas such as air or nitrogen is pumped at high pressure down the wellbore and into the coal seam as in a conventional gas cavitation process. When an appropriate gas pressure is established in the formation surrounding the wellbore, the gas pressure is suddenly released to allow the pressurized gas to flow back from the formation and break the coal into fragments which then can be removed through the wellbore. The process may be repeated as appropriate to increase the cavity size, if desired.

BRIEF DESCRIPTION OF THE DRAWING

The present invention may be better understood by reading the following detailed description of the preferred embodiments with reference to the accompanying drawing which is an elevational view, partly in cross section, of a subterranean coal seam or formation with a wellbore completed therein for practice of the solvent enhanced cavity induced stimulation method of the present invention.

DESCRIPTION OF THE PREFERRED EMBODIMENTS

With reference to the figure, there is illustrated a wellbore 10 which has been drilled to and completed in a coal seam 11. Preferably, the well is first drilled through the overlying earth formations 22 to the top of coal seam 11. Surface casing 12 is then installed and sealed in place by cement 13. The lower open portion of the borehole 24 is then completed through coal seam 11. A tubing 14 is installed to provide a means for circulating fluids from the lower end of the borehole. A valve 16 and conduit 20 are provided in communication with the annulus 26 between tubing 14 and casing 12. For example, air or other fluids may be flowed down tubing 14 and returned through annulus 26 to remove any materials remaining in the open borehole section 24 before the stimulation process is commenced. It is also preferred in the present invention that all liquids in the lower open hole section 24 be displaced with air.

After thus cleaning out the borehole 10, a coal comminuting solvent is pumped down tubing 14 to the open hole section 24 of borehole 10. Solvents which are believed suitable for this purpose include ammonium hydroxide ($NH_4OH$), ammonia ($NH_3$), nitric acid ($HNO_3$), sulfuric acid ($H_2SO_4$), methyl sulfonic acid ($CH_3SO_3H$), and trifluoracetic acid ($CF_3CO_2H$). These materials are believed to be useful at ambient conditions, that is, they do not require application of additional heat or extreme pressures. A solution of ammonium hydroxide is the safest and easiest for this application. The optimum concentration of the solvent will depend on coal type and properties. The solvent is pumped at matrix rates, that is below the minimum in situ stress, until the desired depth of penetration of solvent has been achieved, typically from about five to about eight feet from the borehole. In a typical case, this would require about 12 to 15 barrels of liquid solvent for a 25 foot thick coal seam with 5% porosity. Compressed air or nitrogen is then pumped down tubing 14 to displace the solvent from the borehole into the coal seam 11. Once the solvent has thus been injected into the coal seam 11, pumping is stopped and the well is shut in to let the solvent act. The length of shut-in time is dependent on the coal type, solvent type, reservoir temperature and downhole pressure. During the shut-in time the solvent will dissolve materials in the cleat structure which have added strength to that structure and thus resisted the gas cavitation process. Such materials include natural tars, amberlite and asphalt.

After the preselected shut-in time, a gas such as air or nitrogen is pumped down tubing 14 at high pressure, but below formation fracture pressure, and into the coal seam 11. As in a normal gas cavitation process, pumping is continued until a sufficient bottom hole pressure is achieved and high pressure gas has penetrated sufficiently far into coal seam 11. Valve 16 is then opened to allow high pressure gas to be released from the wellbore 10 through conduit 20 to suddenly drop the wellbore pressure. Since the solvent treatment has reduced the cleat strength of the coal seam 11, the gas flowing back out of seam 11 will cause the desired cavitation about the borehole 10. The coal particles generated by the process may then be removed from the borehole by circulation as done at the beginning of the process.

As illustrated by the dash lines a, b, c and d in the figure, the initial cavitation process may typically generate a cavity along lines a. Repeated steps can expand the cavity to the positions b, c and d, as desired.

While the present invention has been illustrated and described with reference to particular apparatus and methods of operation, it is apparent that various changes can be made therein within the scope of the present invention as defined by the appended claims.

What is claimed is:

1. A method for forming a cavity adjacent an open borehole within a coal seam to improve the production of fluids from the subterranean coal seam comprising:

(a) completing a wellbore into said coal seam;

(b) flowing a coal comminuting solvent down the wellbore to said coal seam and into said coal seam;

(c) flowing a gas down the wellbore and into said coal seam at high pressure; and (d) releasing the pressure in said wellbore.

2. The method of claim 1, wherein said solvent is displaced into said coal seam to a depth of from about five to about eight feet from said wellbore and the wellbore is shut in for a preselected time before flowing said gas down the wellbore.

3. The method of claim 1, wherein said solvent is selected from the group comprising ammonium hydroxide ($NH_4OH$), ammonia ($NH_3$), nitric acid ($HNO_3$), sulfuric acid ($H_2SO_4$), methyl sulfonic acid ($CH_3SO_3H$), and trifluoracetic acid ($CF_3CO_2H$).

* * * * *